US009153150B2

(12) United States Patent
Fallon

(10) Patent No.: US 9,153,150 B2
(45) Date of Patent: Oct. 6, 2015

(54) LIGHTING ASSEMBLY HAVING ENHANCED VISUAL APPEARANCE

(71) Applicant: Green Light Innovations, Lake Saint Louis, MO (US)

(72) Inventor: Timothy G. Fallon, Lake Saint Louis, MO (US)

(73) Assignee: Green Light Innovations, Lake Saint Louis, MO (US)

( * ) Notice: Subject to any disclaimer, the term of this patent is extended or adjusted under 35 U.S.C. 154(b) by 165 days.

(21) Appl. No.: 13/918,216

(22) Filed: Jun. 14, 2013

(65) Prior Publication Data

US 2014/0369041 A1 Dec. 18, 2014

(51) Int. Cl.
*F21V 21/00* (2006.01)
*G09F 13/04* (2006.01)

(52) U.S. Cl.
CPC ..... *G09F 13/0404* (2013.01)

(58) Field of Classification Search
CPC ..... G09F 13/02; G09F 13/04
USPC ..... 362/812, 806, 23, 27; 40/551, 579, 545
See application file for complete search history.

(56) References Cited

U.S. PATENT DOCUMENTS

| | | | | |
|---|---|---|---|---|
| 2,823,475 | A * | 2/1958 | Packard | 40/573 |
| 3,593,446 | A * | 7/1971 | Gesner, III | 40/564 |
| 3,660,918 | A * | 5/1972 | Bourseau | 40/585 |
| 3,758,973 | A * | 9/1973 | Miller | 40/451 |
| 4,186,424 | A * | 1/1980 | Fohl | 362/13 |
| 4,383,382 | A * | 5/1983 | Hegarty | 40/545 |
| 6,042,248 | A | 3/2000 | Hannah et al. | |
| 7,162,821 | B2 | 1/2007 | Venkataraman et al. | |
| 7,213,956 | B2 | 5/2007 | Furuya et al. | |
| D544,038 | S | 6/2007 | Kaoh et al. | |
| 7,467,486 | B2 | 12/2008 | Kaoh | |
| D599,410 | S | 9/2009 | Kaoh | |
| D599,411 | S | 9/2009 | Kaoh | |
| 7,685,753 | B2 | 3/2010 | Slowski | |
| D647,141 | S | 10/2011 | Kaoh | |
| D647,973 | S | 11/2011 | Kaoh | |
| D647,974 | S | 11/2011 | Kaoh | |
| 8,109,020 | B2 * | 2/2012 | Boyles et al. | 40/576 |
| D680,592 | S | 4/2013 | Kaoh | |
| D680,593 | S | 4/2013 | Kaoh | |
| 2007/0283604 | A1 | 12/2007 | Kaoh | |
| 2008/0010879 | A1 | 1/2008 | Kaoh et al. | |
| 2011/0271569 | A1 | 11/2011 | Nelson et al. | |
| 2012/0159818 | A1 | 6/2012 | Kaoh | |

* cited by examiner

*Primary Examiner* — Ali Alavi
(74) *Attorney, Agent, or Firm* — Stinson Leonard Street LLP

(57) ABSTRACT

A lighting assembly includes a housing assembly, a first light source located within the housing assembly, and a second light source located within the housing assembly. A first cover is positioned relative to the first light source so that the first light source is able to illuminate the first cover. A second cover is positioned relative to the second light source so that the second light source is able to illuminate the second cover. A light barrier is disposed between the first and second covers. The light barrier is configured to prevent interference between the first light source and the second light source.

19 Claims, 9 Drawing Sheets

LIGHTING ASSEMBLY HAVING ENHANCED VISUAL APPEARANCE

FIELD

The field relates generally to lighting assemblies and, more specifically, to lighting assemblies having enhanced visual appearances for displaying a message or representation.

BACKGROUND

Illuminated signs are frequently used to advertise or convey a message to customers. Neon tubes, in particular, have been used for many years to provide signs that attract attention. The light emitted by a neon tube is attractive because it is uniformly distributed and brightly colored. However, neon tubes tend to consume large amounts of energy, generate heat, and have relatively short lives, among other things.

As a result, other sources of light, such as light emitting diodes (LEDs), are often used to illuminate signs instead of neon tubes. However, such sources of light tend not to be as effective at distributing light uniformly or as brightly colored. A series of LEDs, for example, often appear as a series of single points of light to an observer. Moreover, a large number LEDs may be required to simulate the brightness of a neon tube. Further, when different colored sources of light are used within the same illuminated sign, the different colored light sources tend to interfere or "bleed" with one another, resulting in undesired lighting effects.

Accordingly, a continuing need exists for a cost-efficient illuminated sign having a visually appealing appearance.

BRIEF SUMMARY

In one aspect, a lighting assembly generally comprises a housing assembly, a first light source located within the housing assembly, and a second light source located within the housing assembly. A first cover is positioned relative to the first light source so that the first light source is able to illuminate the first cover. A second cover is positioned relative to the second light source so that the second light source is able to illuminate the second cover. A light barrier is disposed between the first and second covers. The light barrier is configured to prevent interference between the first light source and the second light source.

In another aspect, a lighting assembly generally comprises a housing assembly and a cover assembly coupled to the housing assembly. The cover assembly including at least one inner cover defining a word and an outer cover at least in part defining a border surrounding the word defined by the inner cover. A first light source is located within the housing assembly and positioned relative to the inner cover so that the first light source is able to illuminate the inner cover. A second light source is located within the housing assembly and positioned relative to the outer cover so that the second light source is able to illuminate the outer cover. A light barrier is disposed between the inner and outer covers. The light barrier is configured to prevent interference between the first light source and the second light source.

In yet another aspect, a lighting assembly generally comprises a housing assembly and a cover assembly coupled to the housing assembly. The cover assembly includes at least one inner cover defining a word and an outer cover at least in part defining a border surrounding the word defined by the inner cover. A first light source is located within the housing assembly and positioned relative to the inner cover so that the first light source is able to illuminate the inner cover. A second light source located within the housing assembly and positioned relative to the outer cover so that the second light source is able to illuminate the outer cover. A light barrier is disposed on the outer cover to block light from the second light source.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols used in the various drawings indicate like elements.

Although specific features of various embodiments may be shown in some drawings and not in others, this is for convenience only. Any feature of any drawing may be referenced and/or claimed in combination with any feature of any other drawing.

DETAILED DESCRIPTION OF THE DRAWINGS

Figure 1:
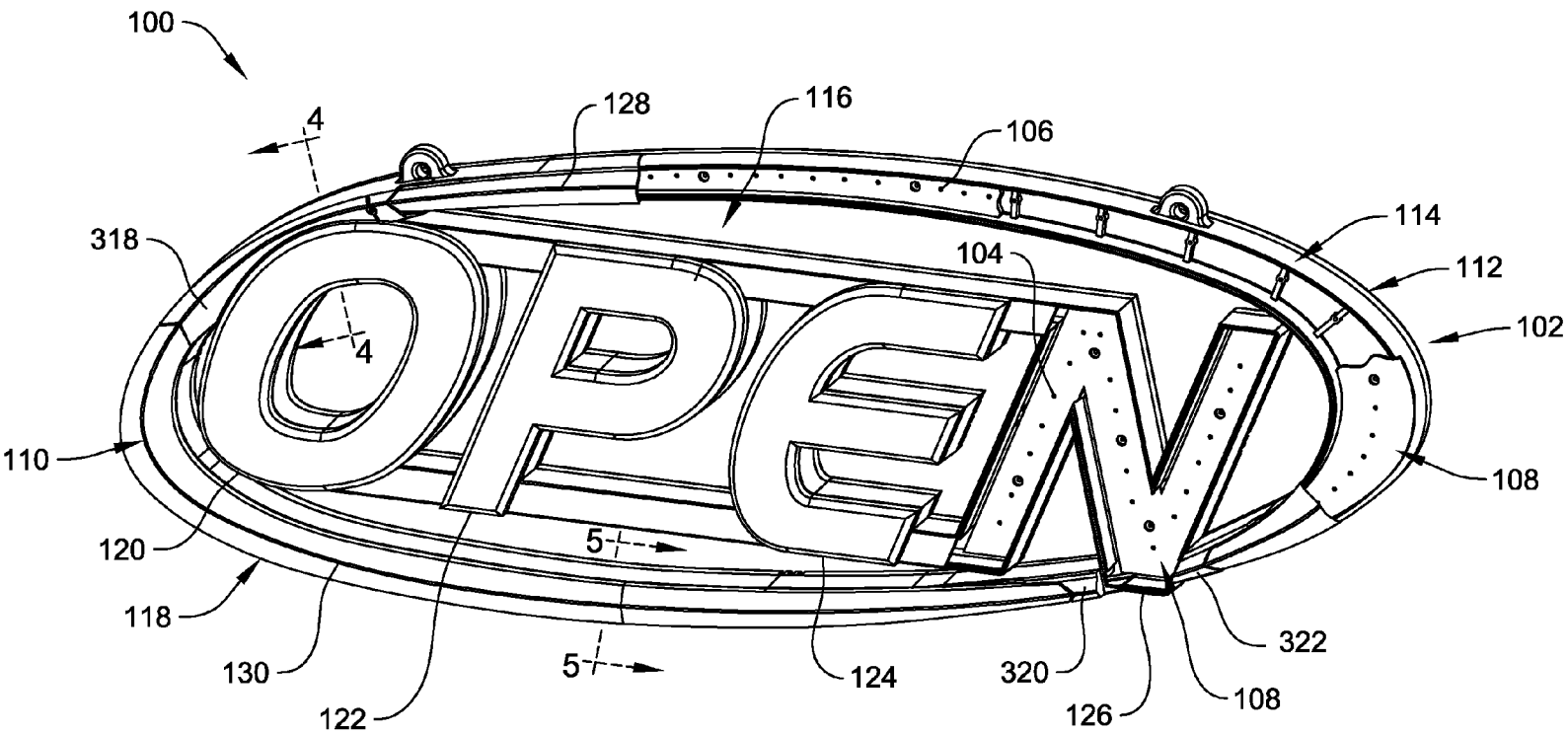
FIG. 1 is a perspective of one suitable embodiment of a lighting assembly, a portion of the lighting assembly being broken away to show underlying features.
Figure 2:
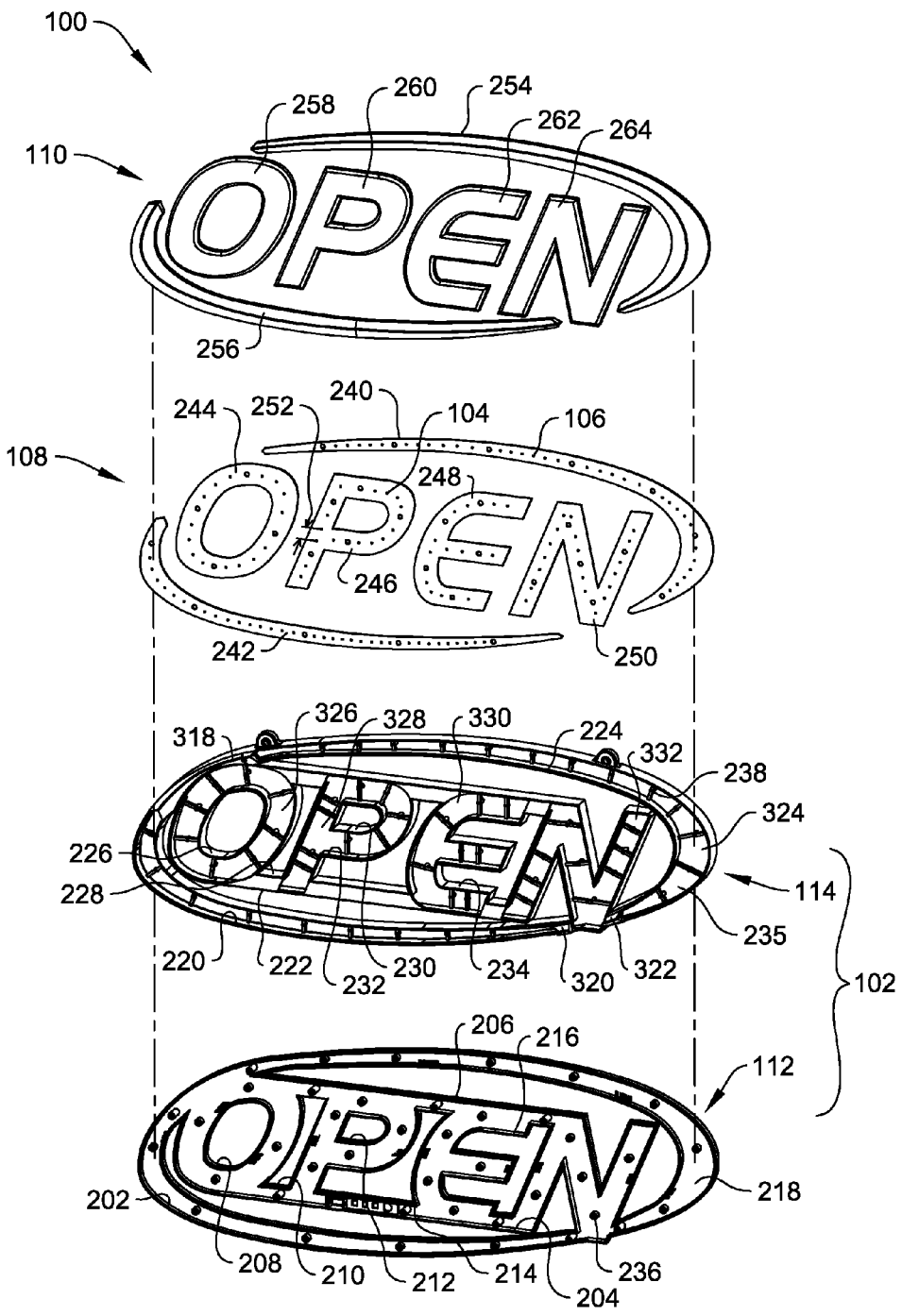
FIG. 2 is an exploded view of the lighting assembly.
Figure 3:
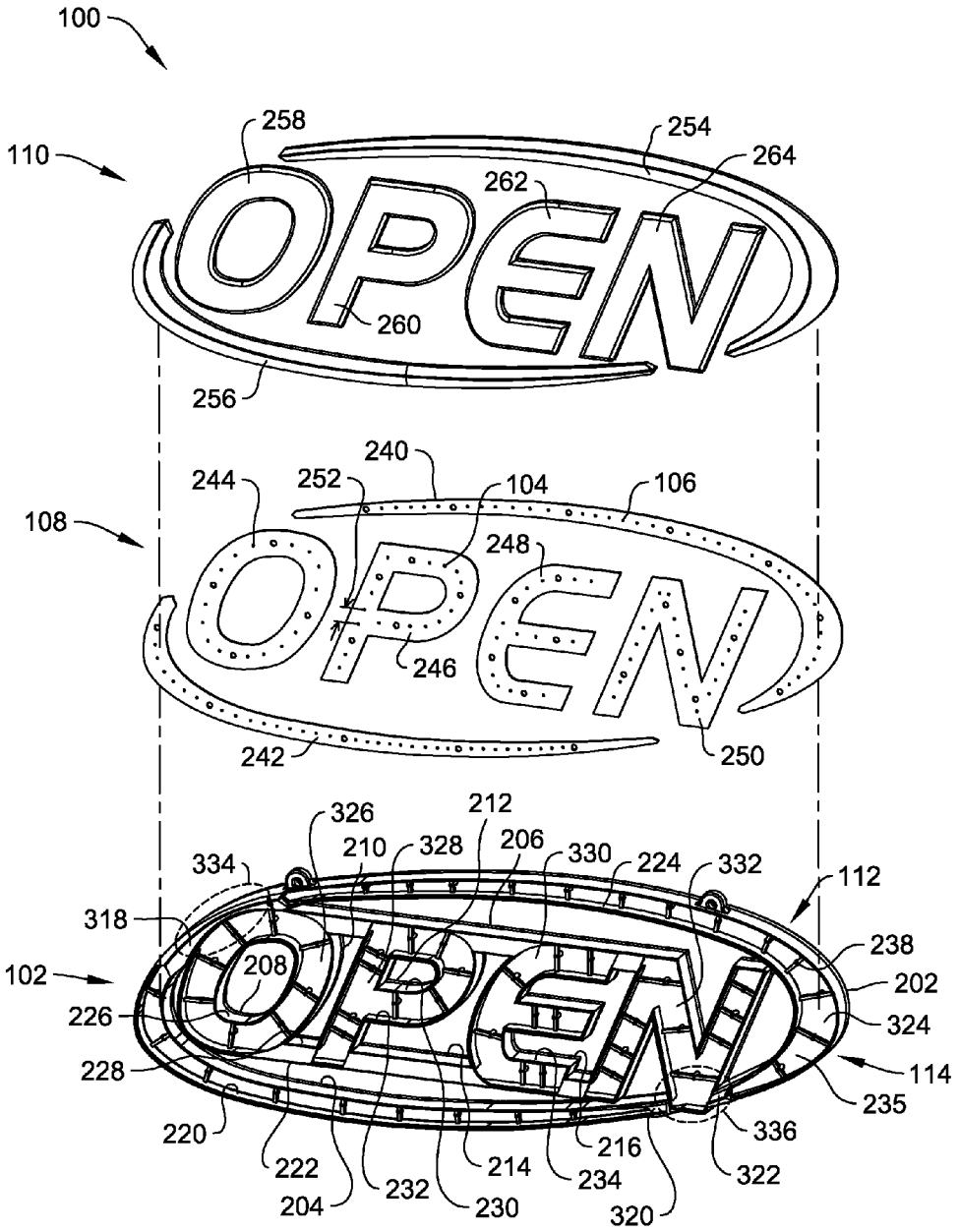
FIG. 3 is an exploded view similar to FIG. 2 but illustrating the lighting assembly partially assembled.

With reference now to FIGS. 1-3, one suitable embodiment of a lighting assembly is indicated generally at 100. FIG. 1 is a perspective of the lighting assembly 100; FIG. 2 is an exploded view of the lighting assembly; and FIG. 3 is a partially exploded view of the lighting assembly. As seen in FIGS. 1-3, the lighting assembly 100 depicts indicia 116. In the illustrated embodiment, the lighting assembly 100 depicts the word "OPEN". Specifically, the illustrated indicia 116 includes an "O" 120, a "P" 122, an "E" 124, and an "N" 126. Although the lighting assembly 100 illustrated in FIGS. 1-3 depicts the word "OPEN", it is understood that other messages or representations, including alphabetical and/or numerical characters (i.e., alphanumeric characters), symbols, graphic elements, features of an object, images, and/or any combination of thereof can be depicted by the lighting assembly without departing from some aspects of this disclosure.

In the embodiment illustrated in FIGS. 1-3, the lighting assembly 100 includes a housing assembly indicated generally at 102, first and second light sources 104, 106 mounted on printed circuit board (PCB) assemblies 108 size and shaped for being located within the housing assembly, and a cover assembly indicated generally at 110. A portion of the cover assembly 110 is broken away in FIG. 1 to show the underlying PCB assembly 108.

In the illustrated embodiment, the housing assembly 102 includes a base, indicated generally at 112, and a housing compartment, indicated generally at 114. The base 102 and housing compartment 114 are coupled together to define the housing assembly 102. It is contemplated that the housing assembly 102 can be formed as a single-piece without departing from some aspects of this disclosure.

As seen in FIG. 1, the housing assembly 102 and the cover assembly 110 collectively define the indicia 116 depicted by lighting assembly 100. A border, indicated generally at 118, extends around the indicia 116. In the illustrated embodiment, the border 118 includes a first border section 128 and a second border section 130. It is understood that the border 118 can be have more or fewer than two sections without departing from some aspects of this disclosure.

FIG. 2 is an exploded view of the lighting assembly 100. As seen in FIG. 2, the base 112 includes an outer base sidewall 202 and a plurality of inner base sidewalls 204, 206, 208, 210, 212, 214, 216 extending away from an internal surface 218 of the base 112. The outer base sidewall 202, which is generally elliptical, extends around and defines a perimeter of base 112. The inner base sidewalls 204, 206, 208, 210, 212, 214, 216 are positioned inward of the outer base sidewall 202. The inner base sidewalls 204, 206, 208, 210, 212, 214, 216 collectively define the indicia 116 depicted by the lighting assembly 100. More specifically, the base 112 includes seven inner base sidewalls 204, 206, 208, 210, 212, 214, 216 each of which at least partially defines at least one of the alphanumeric characters of the word "OPEN" depicted by the lighting assembly 100. Also in the illustrated embodiment, two of the inner base sidewalls 204, 206 cooperate with the outer base sidewall 202 to define the border 118. In the illustrated embodiment, the inner and outer base sidewalls 202, 204, 206, 208, 210, 212, 214, 216 extend upward from and are substantially perpendicular to the surface 218 of the base.

The housing compartment 114 includes an outer housing compartment sidewall 220 and a plurality of inner housing compartment sidewalls 222, 224, 226, 228, 230, 232, 234 having substantially the same arrangement as the corresponding outer and inner base sidewalls 202, 204, 206, 208, 210, 212, 214, 216 of the base 112. Thus when the housing compartment 114 and the base 112 of the lighting assembly 100 are coupled together, the inner and outer housing compartment sidewalls 220, 222, 224, 226, 228, 230, 232, 234 are generally aligned with and spaced above the corresponding inner and outer base sidewalls 202, 204, 206, 208, 210, 212, 214, 216.

The outer housing compartment sidewall 220, which is generally elliptical, extends around and defines a perimeter of housing compartment 114. The inner housing compartment sidewalls 222, 224, 226, 228, 230, 232, 234 are positioned inward of the outer housing compartment sidewall 220. The inner housing compartment sidewalls 222, 224, 226, 228, 230, 232, 234 collectively define the indicia 116 depicted by the lighting assembly 100. More specifically, the housing compartment 114 includes seven inner housing compartment sidewalls 222, 224, 226, 228, 230, 232, 234 each of which at least partially defines at least one of the alphanumeric characters of the word "OPEN" depicted by the lighting assembly 100. Also in the illustrated embodiment, two of the inner housing compartment sidewalls 222, 224 cooperate with the outer housing compartment sidewall 220 to define the border 118. In the illustrated embodiment, the inner and outer housing compartment sidewalls 220, 222, 224, 226, 228, 230, 232, 234 extend upward from and are substantially perpendicular to a surface 235 of the housing compartment 114.

With reference now to FIGS. 1-3, the housing compartment 114 (and thus the housing assembly 102) includes first, second, and third light barriers 318, 320, 322. In the illustrated embodiment, the light barriers 318, 320, 322 are integrally formed as part of the housing compartment 114. In other embodiments, one or more of the light barriers 318, 320, 322 can be formed as separate pieces and removably or fixedly coupled to the housing compartment 114.

As seen in FIGS. 2 and 3, the housing compartment sidewalls 220, 222, 224, 226, 228, 230, 232, 234 define a plurality of channels within the housing assembly 102. Specifically, the outer housing compartment sidewall 220 and two of the inner housing compartment sidewalls 222, 224 define an outer channel 324. The inner housing assembly sidewalls 222, 224, 226, 228, 230, 232, 234 define a plurality of inner channels 326, 328, 330, 332. The inner channels 326, 328, 330, 332 are patterned to depict indicia 116. In the illustrated embodiment, one of the inner channels 326 is patterned in the shape of an "O" 120, another one of the inner channels 328 is patterned in the shape of a "P" 122, another one of the inner channels 330 is patterned in the shape of an "E" 124, and another one of the inner channels 332 is patterned in the shape of a "N" 126.

The outer channel 324 corresponds to the boarder 118 extending around indicia 116. In the illustrated embodiment, the inner channel 326 defining the "O" overlaps, or intersects, the outer channel 324 along a first overlap region 334. Also in the illustrated embodiment, the inner channel 332 defining the "N" 126 overlaps, or intersects, outer channel 324 along a second overlap region 336.

It is contemplated that the base 112 and the housing compartment 114 can be formed from any suitable material, including moldable plastics, such as acrylonitrile butadiene styrene (ABS) and acrylic. In the illustrated embodiment, for example, the base 112 and the housing assembly 114 are formed from opaque injection molded plastic, described in more detail below.

Together, the base 112 and the housing compartment 114 form the housing assembly 102, which houses the PCB assemblies 108 and thus the light sources 104, 106. The housing compartment 114 can be coupled to the base 112 by a variety of means including, for example, screws, adhesive, and/or an interference fit. In the illustrated embodiment, for example, the base 112 includes threaded through-holes 236 and the housing compartment 114 includes through-holes 238 for receiving threaded fasteners (not shown). In another suitable embodiment, the base 112 and the housing compartment 114 can be integrally formed such that the housing assembly 102 has a unitary construction.

The first and second light sources 104, 106 are positioned within the housing assembly 102 to illuminate the message or representation depicted by lighting assembly 100. In the illustrated embodiment, the first light sources 104 are housed within the inner channels 326, 328, 330, 332 of housing compartment 114, and the second light sources 106 are housed within the outer channel 324 of housing compartment. The first and second light sources 104, 106 are mounted on and electrically connected to the respective PCB assembly 108, which are mounted to housing compartment 114 by any suitable means, such as screws and/or adhesive.

As seen in FIGS. 2 and 3, the PCB assemblies 108 include outer PCBs 240, 242, and inner PCBs 244, 246, 248, 250. The outer PCBs 240, 242 are configured to be received within the outer channel 324, and the inner PCBs 244, 246, 248, 250 are configured to be received within the inner channels 326, 328, 330, 332, respectively. Furthermore, the first light sources 104 are mounted on and electrically connected to the inner PCBs 244, 246, 248, 250, and the second light sources 106 are electrically connected to the outer PCBs 240, 242.

The first light sources 104 may be a single light source or a plurality of point light sources. In embodiments using a plurality of point light sources, the first light sources 104 may be evenly spaced apart by a distance 252. The distance 252 represents the distance between adjacent lights sources positioned within the same channel, also known as "pitch". In the illustrated embodiment, for example, the distance 252 between one of the first light sources 104 and an adjacent first light source is between about 10 millimeters and about 15 millimeters, more specifically between about 12 millimeters and about 14 millimeters, and, even more specifically, the distance is about 12 millimeters. In other embodiments, the first light sources 104 may be randomly positioned with random pitch. In addition, the first light sources 104 may be any suitable light source including, for example, LEDs. The first light sources 104 may be mounted by a soldered connection to electrical traces on the inner PCBs 244, 246, 248, 250, and may provide substantially white light or a colored light, such as green, red, blue, purple, orange, yellow, etc. Furthermore, different light sources may be of different colors. The second light sources 106 may have a substantially similar configuration to the first light sources 104, or the second light sources may have any other suitable configuration, such as those described above with reference to the first light sources, that enables lighting assembly 100 to function as described herein. The PCB assemblies 108 can be formed of any suitable rigid material, such as an FR-4 laminate with conductive traces embedded therein.

The cover assembly 110 is sized and shaped to close the channels 324, 326, 328, 330, 332 in the housing assembly 102. The cover assembly 110 can be mounted to the housing assembly 102 using a variety of means including, for example, screws, adhesive, and/or an interference fit. Similar to the base 112 and the housing compartment 114, the cover assembly 110 may be formed from a variety of materials, including moldable plastics, such as acrylonitrile butadiene styrene (ABS) and acrylic.

In the illustrated embodiment, the cover assembly 110 includes a pair of outer covers 254, 256, which are configured to close to the outer channel 324, and a plurality of inner covers 258, 260, 262, 264, configured to close respective ones of the inner channels 326, 328, 330, 332. As a result, the inner covers 258, 260, 262, 264 are illuminated by the first light source 104 and the outer covers 254, 256 are illuminated by the second light source 106.

As seen in FIGS. 1 and 3, the inner covers 258, 260, 262, 264 are shaped in substantially the same pattern as the indicia 116. More specifically, in the illustrated embodiment, one of the inner covers 258 is patterned in the shape of an "O" 120, another one of the inner covers 260 is patterned in the shape of a "P" 122, another one of the inner covers 262 is patterned in the shape of an "E" 124, and another one of the inner covers 264 is patterned in the shape of a "N" 126. One of the outer covers 254 is shaped in substantially the same pattern as the first border section 128, and the other outer cover 256 is shaped in substantially the same pattern as the second border section 130. As seen in FIG. 1, the border 130, defined by the housing assembly 102 and the outer covers 254, 256, only partially extends around the outer channel 324. In particular, the border 118 does not extend through the first and second overlap sections 334, 336.

As illustrated in FIG. 1, the first, second, and third light barriers 318, 320, 322 of the housing assembly 102 are disposed between the outer covers 254, 256 and two of the inner covers 258, 264. The first, second, and third light barriers 318, 320, 322 are configured to prevent light emitted from the first light source 104 from interfering (also known as "bleeding") with light emitted from the second light source 106 and vice versa. More specifically, in the illustrated embodiment, the first, second, and third light barriers 318, 320, 322 are configured to prevent light emitted from the first light source 104 and impinging upon the inner covers 258, 260, 262, 264 from bleeding with light emitted from the second light source 106 and impinging upon the outer covers 254, 256. The first, second, and third light barriers 318, 320, 322 are configured to also prevent light emitted from the second light source 106 and impinging upon the outer covers 254, 256 from bleeding with light emitted from the first light source 104 and impinging upon the inner covers 258, 260, 262, 264.

As seen in FIGS. 2 and 3, the first light barrier 318, which is located in the first overlap region 334, is positioned between the "O"-shaped inner cover 258 and the outer covers 254, 256 defining the border 118. As shown in FIGS. 1 and 2, each of the outer covers 254, 256 and the "O"-shaped inner cover 258 directly abut the first light barrier 318. More specifically, each of the outer covers 254, 256 abuts a respective end of the first light barrier 318, and the "O"-shaped inner cover 258 abuts the first light barrier 318 along one its longitudinal extending sides. The respective longitudinal extending side of the first light barrier 318 is shaped to abut the "O"-shaped inner cover 258 along an arcuate or curved surface. The first light barrier 318 is sized and shaped to provide sufficient spacing and/or light obstruction between the "O"-shaped inner cover 258 and the outer covers 254, 256 such that light illuminating the outer covers does not bleed with light illuminating the "O"-shaped inner cover 258.

The second and third light barriers 320, 322 similarly prevent light illuminating from the outer covers 254, 256 from bleeding with light illuminating from the "N"-shaped inner cover 264. The second and third light barriers 320, 322 are located in the second overlap region 336 (FIG. 3). One of the outer covers 256 extends inwardly into one end of the second light barrier 320, and the other outer cover 254 extends inwardly into the third light barrier 322. The second light barrier 320 is positioned between one of the outer covers 256 and the "N"-shaped inner cover 264, and the third light barrier 322 is positioned between the other outer cover 254 and the "N"-shaped inner cover 264. Additionally, a portion of the "N"-shaped inner cover 264 is positioned between the second and third light barriers 320, 322 such that the second and third light barriers are spaced-apart by the portion of the "N"-shaped inner cover. The second and third light barriers 320, 322 provide sufficient spacing and/or light obstruction between the "N"-shaped inner cover 264 and the outer covers 254, 256 such that light illuminating from the outer covers 254, 256 does not bleed with light illuminating from the "N"-shaped inner cover 264.

As described above, the base 112, the housing compartment 114, the housing assembly 102, and the cover assembly 110 may be formed from moldable plastic materials, such as ABS or acrylic. Many different combinations of illumination effects may be achieved with lighting assembly 100 by varying the materials used for the base 112, the housing compartment 114, the housing assembly 102, the light barriers 318, 320, 322, and the covers 254, 256, 258, 260, 262, 264. For example, any one of or all of the base 112, the housing compartment 114, the housing assembly 102, the light barriers 318, 320, 322, and the covers 254, 256, 258, 260, 262, 264 may be formed with opaque, translucent, or transparent material. Moreover, the materials used to form any one of or all of the base 112, the housing compartment 114, the housing assembly 102, the light barriers 318, 320, 322, and the covers 254, 256, 258, 260, 262, 264 may be colored so as to transmit light of a predetermined color. Additionally, a frosted or textured finish may be added to any surface, inner or outer, of the base 112, the housing compartment 114, the housing assembly 102, the light barriers 318, 320, 322, and the covers 254, 256, 258, 260, 262, 264.

In the embodiment illustrated in FIGS. 1-3, each of the covers 254, 256, 258, 260, 262, 264 is formed of a translucent or transparent material, and each of the light barriers 318, 320, and 322 is formed from an opaque material. More specifically, in the illustrated embodiment, each of the covers 254, 256, 258, 260, 262, 264 is formed of clear acrylic having a frosted or textured finish on an interior surface, and each of the light barriers 318, 320, 322 is formed of an opaque black ABS. In the illustrated embodiment, the base 112 and the housing compartment 114 (and thus, the housing assembly 102) are also formed of an opaque black ABS. In one suitable embodiment, the opaque black ABS has a hair-cell textured finish on one or more surfaces. The hair-cell textured finish reduces visibility of scratches that may occur during shipping and handling.

In an alternative embodiment, all or a portion of the base 112, the housing compartment 114, and/or housing assembly 102 may be formed of transparent or translucent plastic. As a result, light from the light sources 104, 106 may be visible from peripheral and/or negative angles of observation with respect to a front perspective view of the lighting assembly 100. One or more of the surfaces defining the channels 324, 326, 328, 330, 332, may be at least partially reflective so that light emitted from the light sources 104, 106 is reflected toward the covers 254, 256, 258, 260, 262, 264.

Figure 4:
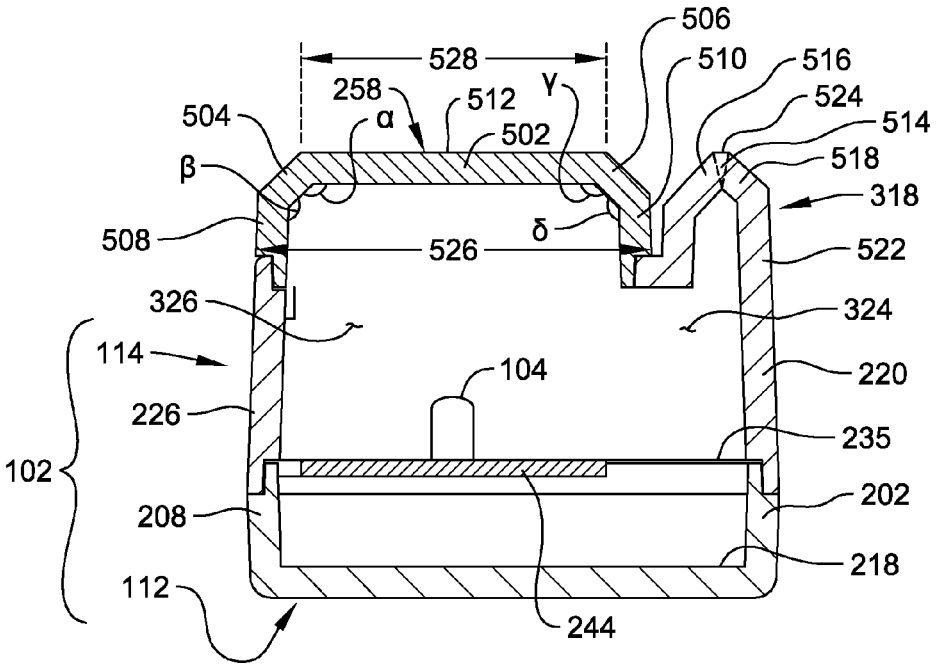
FIG. 4 is a partial cross-section of the lighting assembly taken along line 4-4 of FIG. 1.

FIG. 4 is a cross-section of the lighting assembly 100 taken along line 4-4 of FIG. 1. As seen in FIG. 4, the inner cover 258 includes a front or forward-facing facet 502, a pair of angled facets 504, 506 on opposite sides of the front facet, and a pair of side facets 508, 510 wherein each of the side facets extend downward from a respective one of the angled facets. The facets 502, 504, 506, 508, 510 in the illustrated embodiment are translucent. Accordingly, light from the light sources 104, 106 is guided by the facets 502, 504, 506, 508, 510 in different directions such that each of the facets is visibly distinct to an observer. Moreover, light may be diffused by a frosted inner and/or outer surface on one or more of the facets 502, 504, 506, 508, 510. It is understood that one or more of the facets 502, 504, 506, 508, 510 can be transparent.

When the lighting assembly 100 is in an assembled configuration, the front facet 502 extends between the angled facets 504, 506 in a direction substantially parallel to the front surface 218 of the base 112. One of the angled facets 504 extends between the front facet 502 and a respective one of the side facets 508 (i.e., the left side facet as viewed in FIG. 4). The other angled facet 506 extends between the front facet 502 and the opposite side facet 510 (i.e., the right side facet as viewed in FIG. 4). The side facets 508, 510 extend in a direction substantially perpendicular to the front facet 502.

As viewed in FIG. 4, the left angled facet 504 forms an angle $\alpha$ with respect to the front facet 502 and an angle $\beta$ with respect to the respective side facet 508. Similarly, the right angled facet 506 forms an angle $\gamma$ with respect to the front facet 502, and an angle $\delta$ with respect to the side facet 510. In the illustrated embodiment, each of the angles $\alpha$, $\beta$, $\gamma$, $\delta$ is obtuse, yet sharp enough such that the abutting facets are visibly distinct to an observer when light is transmitted through each facet.

In the illustrated embodiment, the angles $\alpha$, $\beta$, $\gamma$, $\delta$ range from between about 1 degrees and about 179 degrees, more specifically between about 40 and 160 degrees, yet even more specifically between about 70 and about 150 degrees, and yet even more specifically, each angle $\alpha$, $\beta$, $\gamma$, and $\delta$ is about 135 degrees. Further, in the example embodiment, the sum of angles $\alpha$ and $\beta$ is between about 1 degrees and about 359 degrees, more specifically between about 30 degrees and about 329 degrees, and even more specifically, the sum of angles $\alpha$ and $\beta$ is about 270 degrees. Similarly, the sum of angles $\gamma$ and $\delta$ is between about 1 degrees and about 359 degrees, more specifically between about 30 degrees and about 329 degrees, and even more specifically, the sum of angles $\gamma$ and $\delta$ is about 270 degrees. It is understood that the angles $\alpha$, $\gamma$, $\beta$, $\delta$ can be substantially the same angle or that they can be different angles.

As seen in FIG. 4, the inner cover 258 also includes a front surface 512 defining the forward- or outer-most surface of the inner cover. In the illustrated embodiment, each of the other inner covers 260, 262, 264 (i.e., the inner covers for the "P" 122, the "E" 124, and the "N" 126) also includes a front facet, side facets, angled facets, and front surfaces substantially similar to those of the inner cover 258 for the "O" 120. In the illustrated embodiment, each front surface of the inner covers 258, 260, 262, 264 is substantially co-planar with the front surfaces of other covers such that the lighting assembly 100 has a substantially flat or planar front surface.

With reference again to FIG. 4, the outer surfaces of the opposing side facets 508, 510 are spaced apart by a distance 526. The distance 526 between the outer surfaces of the opposing side facets 508, 510 in the illustrated embodiment is greater than a width 528 of the front surface 512. In the illustrated embodiment, the distance 526 between the outer surfaces of the opposing side facets 508, 510 is between about 5 mm and about 50 mm, more specifically between about 10 mm and about 45 mm, and even more specifically, the distance 526 between the outer surfaces of opposing side facets 508, 510 is about 20 mm. The width 528 of the front surface 512 is between about 5 mm and about 40 mm, more specifically between about 10 mm and about 35 mm, and even more specifically, the width 528 of the front surface 512 is about 12 mm.

Still referring to FIG. 4, the first light barrier 318, includes a front segment 514, a pair of angled segments 516, 518, and a pair of opposed side segments 520, 522. The first light barrier 318 also includes a front surface 524 defining the forward- or outer-most surface of first light barrier 318. In the illustrated embodiment, each of the other light barriers 320, 322 includes front segments, angled segments, side segments, and front surfaces substantially similar to those of the first light barrier 318. Also in the illustrated embodiment, each of the front surface of the light barriers 318, 320, 322 is substantially co-planar with the front surfaces of the inner covers 258, 260, 262, 264, the outer covers 254, 256, and the other light barriers such that lighting assembly 100 has a substantially flat or planar front surface.

Figure 5:
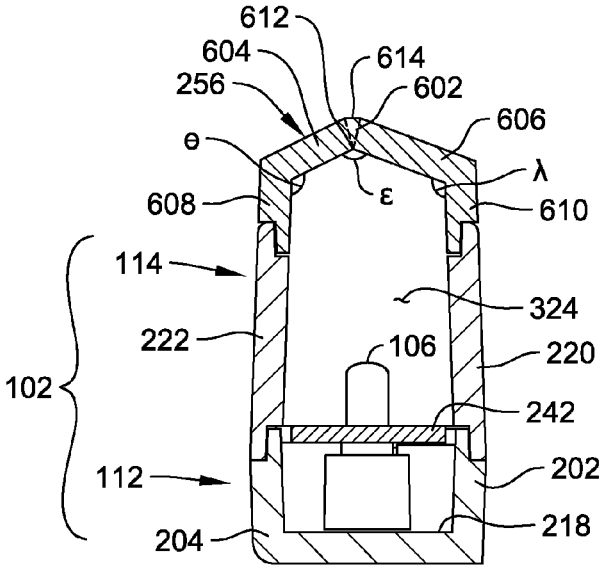
FIG. 5 is partial cross-section of the lighting assembly taken along line 5-5 of FIG. 1.

FIG. 5 is a cross-section taken along line 5-5 of FIG. 1. As seen in FIG. 5, the outer cover 256 includes a front or forward-facing facet 602, a pair of angled facets 604, 606, and opposed side facets 608, 610. The facets 602, 604, 606, 608, 610 are substantially similar to the corresponding facets 502, 504, 506, 508, 510 of the inner cover 258 described above, except that the angled facets 604, 606 adjoin one another at a vertex 612 along in internal surface of the outer cover 256, forming an angle ϵ. In the example embodiment, the angle ϵ is between about 1 degree and about 180 degrees, more specifically between about 20 degrees and about 160 degrees, and even more specifically, ϵ is about 110 degrees. As seen in FIG. 5, the angled facets 604, 606 form angles θ and λ with the respective side facet 606, 610, respectively. The angles θ and λ may be substantially equal to one another, or may be different from one another. In the illustrated embodiment, the angles θ and λ are between about 1 and 180, more specifically between about 20 and 160, and even more specifically, θ and λ are about 100.

As seen in FIG. 5, the outer cover 256 includes a front surface 614 defining the forward- or outer-most surface of outer cover 256. In the example embodiment, the other outer cover 254 includes a front facet, side facets, angled facets, and front surfaces substantially similar to those of the outer cover 256. Also, each front surface of the outer covers 254, 256 is substantially co-planar with the front surfaces of other covers and light barriers such that lighting assembly 100 has a substantially flat or planar front surface.

Figure 6:
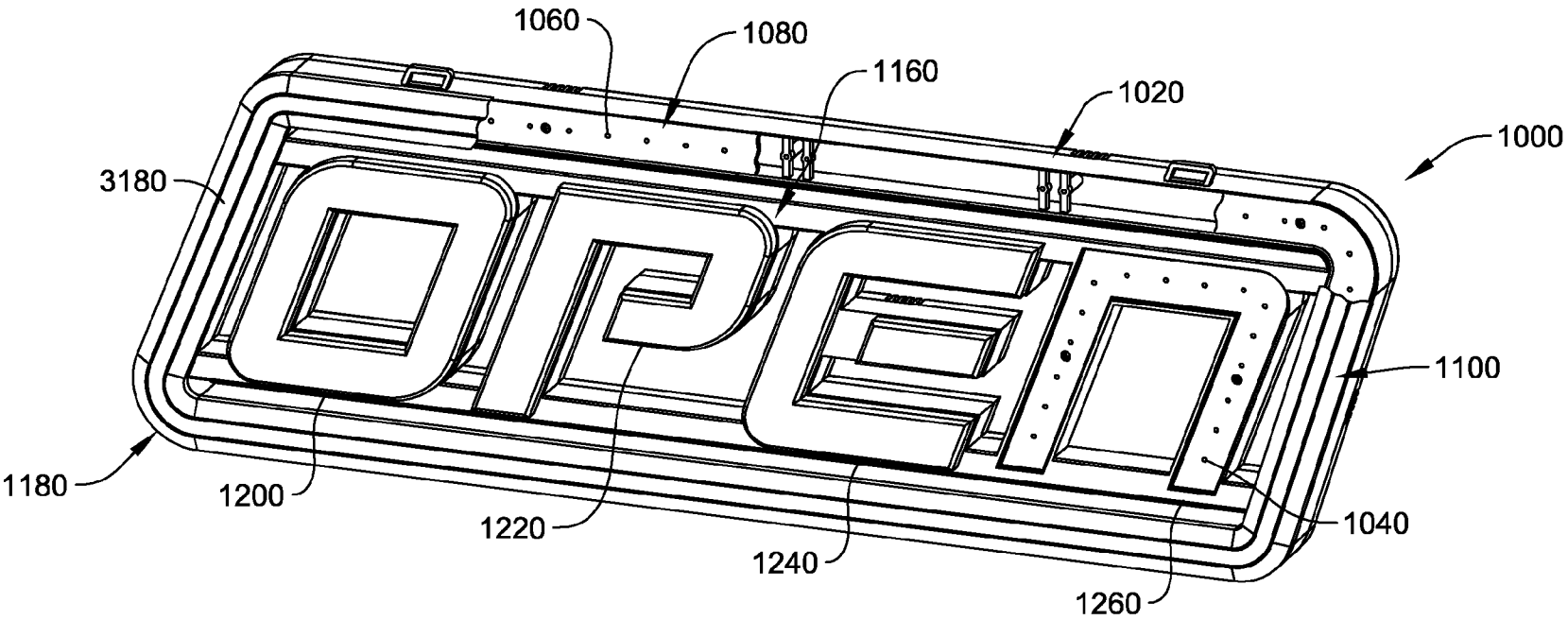
FIG. 6 is a perspective of another suitable embodiment of a lighting assembly.
Figure 7:
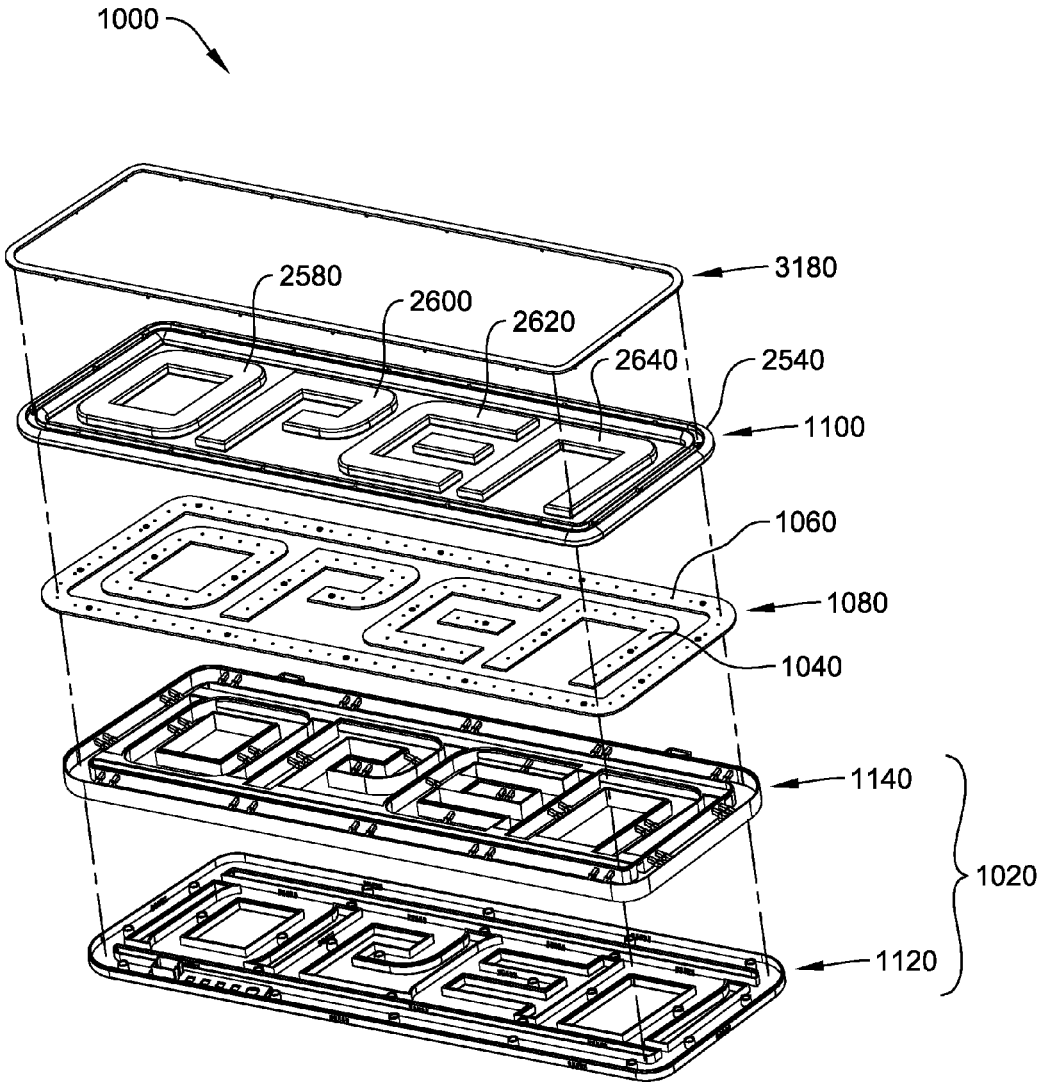
FIG. 7 is an exploded view of the lighting assembly of FIG. 6.

With reference now to FIGS. 6-9, another suitable suitable embodiment of a lighting assembly is indicated generally at 1000. FIG. 6 is a perspective of the lighting assembly 1000 and FIG. 7 is an exploded view of the lighting assembly. As seen in FIGS. 6 and 7, the lighting assembly 1000 depicts indicia 1160. In the illustrated embodiment, the lighting assembly 1000 depicts the word "OPEN". Specifically, the illustrated indicia 1160 includes an "O" 1200, a "P" 1220, an "E" 1240, and an "N" 1260. Although the lighting assembly 1000 illustrated in FIGS. 6-9 depicts the word "OPEN", it is understood that other messages or representations, including alphabetical and/or numerical characters (i.e., alphanumeric characters), symbols, graphic elements, features of an object, images, and/or any combination of thereof can be depicted by the lighting assembly without departing from some aspects of this disclosure.

In the embodiment illustrated in FIGS. 6-9, the lighting assembly 1000 includes a housing assembly indicated generally at 1020 and a cover assembly indicated generally at 1100. As seen in FIG. 7, the housing assembly 1020 includes a base, indicated generally at 1120, and a housing compartment, indicated generally at 1140. The base 1120 and housing compartment 1140 are coupled together to define the housing assembly 1020. It is contemplated that the housing assembly 1020 can be formed as a single-piece without departing from some aspects of this disclosure.

As seen in FIG. 6, the housing assembly 1020 and the cover assembly 1100 collectively define the indicia 1160 depicted by lighting assembly 1000. A border, indicated generally at 1180, extends around the indicia 1160. In the illustrated embodiment, the border 1180 is continuous. It is understood that the border 1180 can be divided into discontinuous sections without departing from some aspects of this disclosure.

Figure 8:
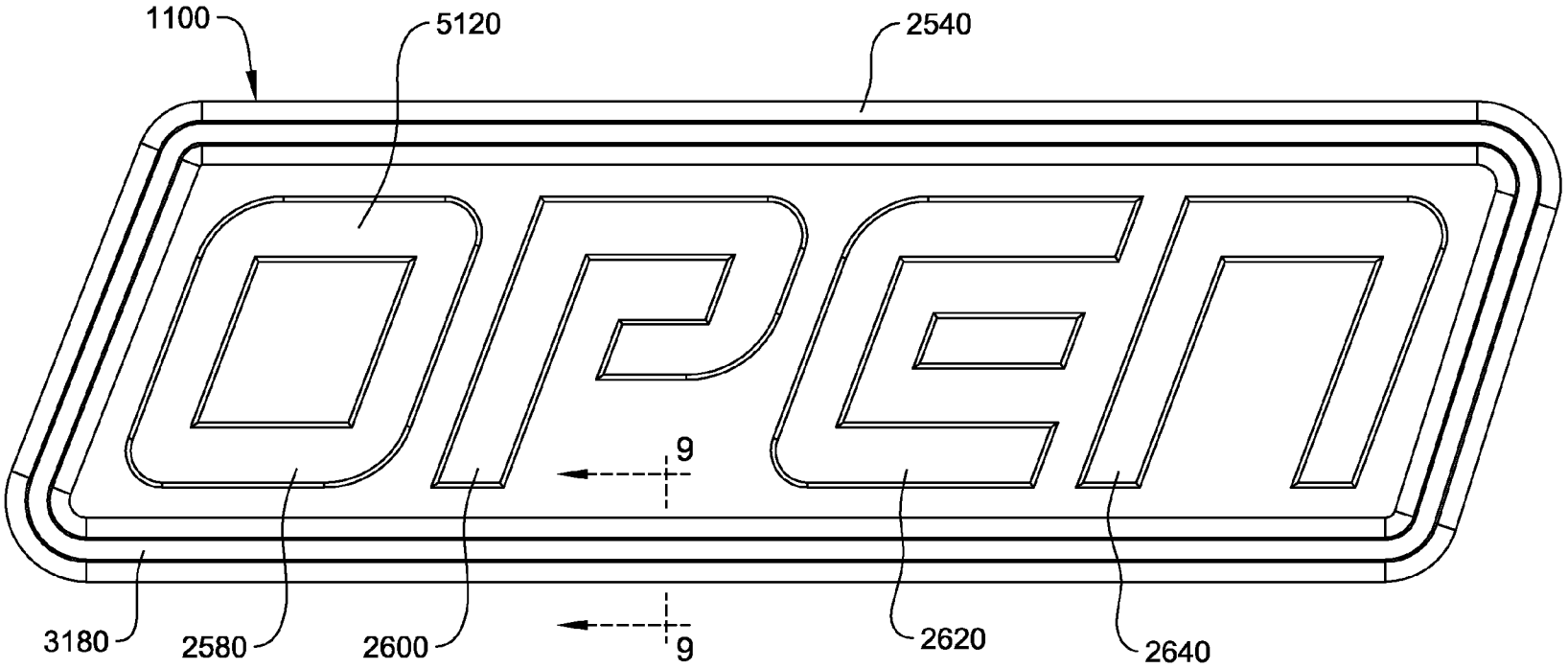
FIG. 8 is a top plan view of a cover assembly removed from the lighting assembly.
Figure 9:
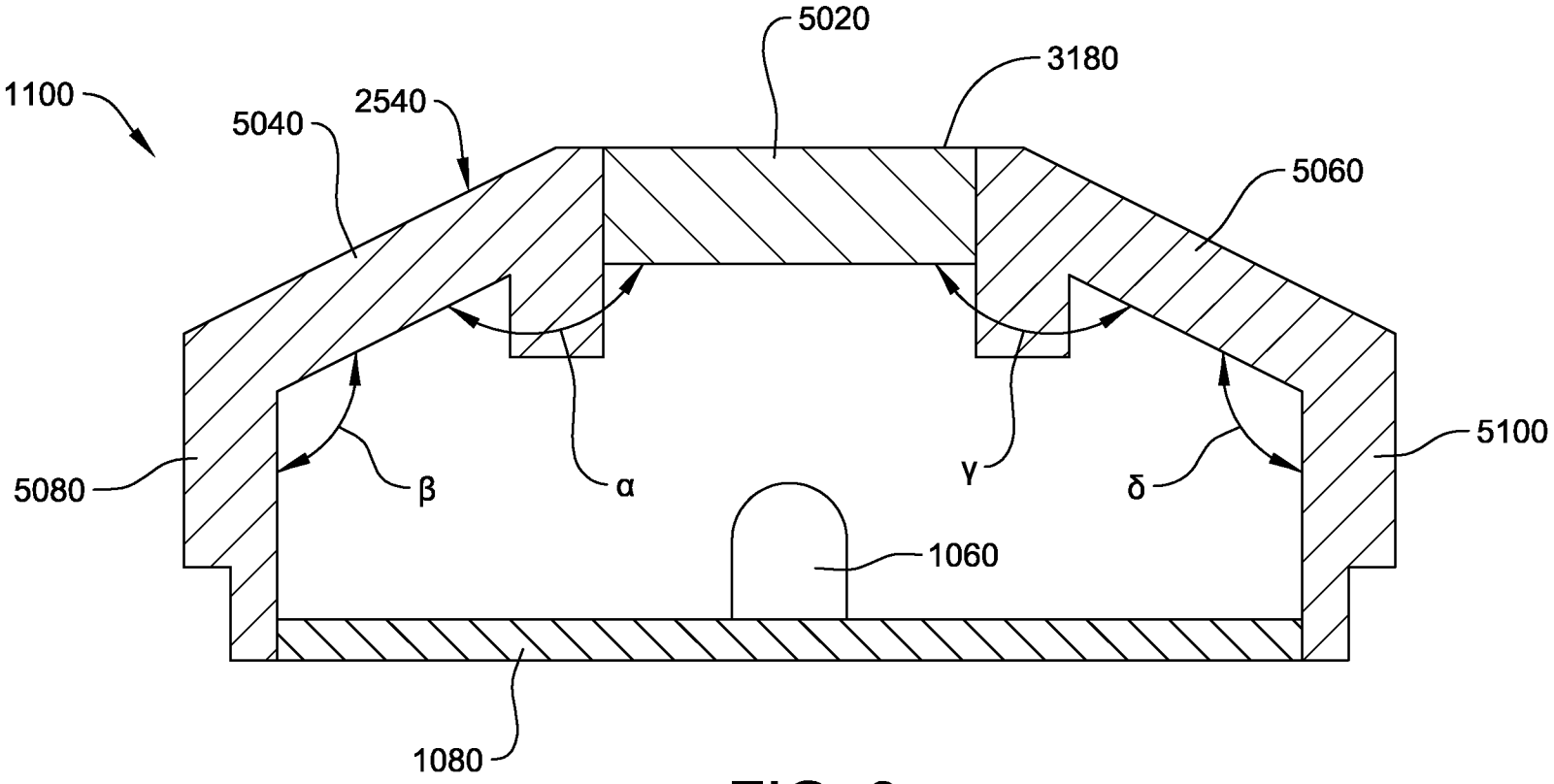
FIG. 9 is a cross-sectional view of the cover assembly taken along line 9-9 of FIG. 8.

With reference now to FIGS. 8 and 9, the border includes a light barrier 3180. In the illustrated embodiment, the light barrier 3180 extends continuous along an apex (or centerline) of the border 1180, which is generally elliptical. As a result, the border 1180 is divided into two visible segments by the light barrier 3180. As a result, during use of the lighting assembly 1000, the border 1180 appears as two discrete borders to an observer with one of the borders being located outside the light barrier 3180 and the other border being located inside the light barrier. In the illustrated embodiment, the border 1180 slopes downward away from both sides (i.e., the inside and the outside) of the light barrier 3180.

In the illustrated embodiment, the light barrier 3180 is formed separately from the boarder 1180 and coupled thereto. While any suitable coupling means could be used, the illustrated light barrier 3180 is coupled to the border 1180 via a snap fit connection. It is contemplated that the snap fit connection can be selectively releasable or fixed. That is, the light barrier 3180 can be releasably or fixedly attached to the border 1180. It is also contemplated that in other suitable embodiments the light barrier 3180 can be formed as a single piece with the border 1180.

First and second light sources 1040, 1060 are positioned within the housing assembly 1020 to illuminate the message or representation depicted by lighting assembly 1000. In the illustrated embodiment, the first light sources 1040 illuminate the word "OPEN" including the "O" 1200, "P" 1220, "E" 1240, and "N" 1260 during use. The second light sources 1060 are provided to illuminate the border 1180. The first and second light sources 1040, 1060 are mounted on and electrically connected to respective PCB assemblies 1080 (or any suitable substrate), which are mounted to the housing compartment 1140 by any suitable means, such as screws and/or adhesive.

Each of the first and second light sources 1040, 1060 may be a single light source or a plurality of point light sources. In embodiments using a plurality of point light sources, the first and second light sources 1040, 1060 may be evenly spaced apart by a distance. The distance represents the distance between adjacent lights sources positioned within the same channel, also known as "pitch". In the illustrated embodiment, for example, the distance or pitch between one of the light sources 1040, 1060 and an adjacent light source is between about 10 millimeters and about 15 millimeters, more specifically between about 12 millimeters and about 14 millimeters, and, even more specifically, the distance is about 12 millimeters. In other embodiments, the light sources 1040, 1060 may be randomly positioned with random pitch.

In addition, the first and second light sources 1040, 1060 may be any suitable light source including, for example, LEDs. The light sources 1040, 1060 may provide substantially white light or a colored light, such as green, red, blue, purple, orange, yellow, etc. Furthermore, different light sources may be of different colors. Moreover, the second light sources 1060 may have a substantially similar configuration to the first light sources 1040, or the second light sources may have any other suitable configuration.

In the illustrated embodiment, the cover assembly 1100 includes an outer cover 2540 corresponding to the border 1180 and a plurality of inner covers 2580, 2600, 2620, 2640 with each of the inner covers corresponding to a respective one of the "O" 1200, "P" 1220, "E" 1240, and "N" 1260. During use, the inner covers 2580, 2600, 2620, 2640 are illuminated by the first light sources 1040 and the outer cover 2540 is illuminated by the second light sources 1060.

As illustrated in FIGS. 8 and 9, the light barrier 3180 defines a portion of the outer cover 2540 is configured to block light emitted from the second light source 1060 from being seen by an observer. As a result, the portion of the outer cover 2540 defined by the light barrier 3180 is not illuminated by the second light source 1060. However, the portions of the outer cover 2540 of opposite sides (i.e., the inside and the outside) of the light barrier 3180 are illuminated by the second light source 1060.

In the embodiment illustrated in FIGS. 6-9, each of the covers 2540, 2580, 2600, 2620, 2640 is formed of a translucent or transparent material, and the light barrier 3180 is formed from an opaque material. More specifically, in the illustrated embodiment, each of the covers 2540, 2580, 2600, 2620, 2640 is formed of clear acrylic having a frosted or textured finish on an interior surface, and the light barriers 3180 is formed of an opaque black ABS.

FIG. 9 is a cross-section of the cover assembly 1100 taken along line 9-9 of FIG. 8. As seen in FIG. 9, the outer cover 2540 includes a front or forward-facing facet 5020 defined by the light barrier 3180, a pair of angled facets 5040, 5060 on opposite sides of the front facet, and a pair of side facets 5080, 5100 wherein each of the side facets extend downward from a respective one of the angled facets. The front facet 5020 is opaque and the other facets 5040, 5060, 5080, 5100 in the illustrated embodiment are translucent. Accordingly, light from the second light sources 1060 is guided by the facets 5040, 5060, 5080, 5100 in different directions such that each of the translucent facets is visibly distinct to an observer. Light may be diffused by a frosted inner and/or outer surface on one or more of the facets 5040, 5060, 5080, 5100. The front facet 5020 blocks (i.e., inhibits) light from the second light source 1060 from being visible to the observer.

As viewed in FIG. 9, the left angled facet 5040 forms an angle $\alpha$ with respect to the front facet 5020 and an angle $\beta$ with respect to the respective side facet 5080. Similarly, the right angled facet 5060 forms an angle $\gamma$ with respect to the front facet 5020, and an angle $\delta$ with respect to the side facet 5100. In the illustrated embodiment, each of the angles $\alpha$, $\beta$, $\gamma$, $\delta$ is obtuse, yet sharp enough such that the abutting facets are visibly distinct to an observer when light is transmitted through each facet.

In the illustrated embodiment, the angles $\alpha$, $\beta$, $\gamma$, $\delta$ range from between about 1 degrees and about 179 degrees, more specifically between about 20 and 170 degrees, yet even more specifically between about 30 and about 160 degrees, and yet even more specifically, each angle $\alpha$, $\beta$, $\gamma$, and $\delta$ is about 135 degrees. Further, in the example embodiment, the sum of angles $\alpha$ and $\beta$ is between about 1 degrees and about 359 degrees, more specifically between about 30 degrees and about 329 degrees, and even more specifically, the sum of angles $\alpha$ and $\beta$ is about 270 degrees. Similarly, the sum of angles $\gamma$ and $\delta$ is between about 1 degrees and about 359 degrees, more specifically between about 30 degrees and about 329 degrees, and even more specifically, the sum of angles $\gamma$ and $\delta$ is about 270 degrees. It is understood that the angles $\alpha$, $\gamma$, $\beta$, $\delta$ can be substantially the same angle or that they can be different angle.

As seen in FIG. 8, each of the inner covers 2580, 2600, 2620, 2640 includes a front surface 5120 defining the forward- or outer-most surface of the inner cover. Each of the front surfaces 5120 of the inner covers 2580, 2600, 2620, 2640 is substantially co-planar with the front surfaces of other covers and the barrier 3180 of the outer cover 2540 such that the lighting assembly 100 has a substantially flat or planar front surface.

Figure 10:
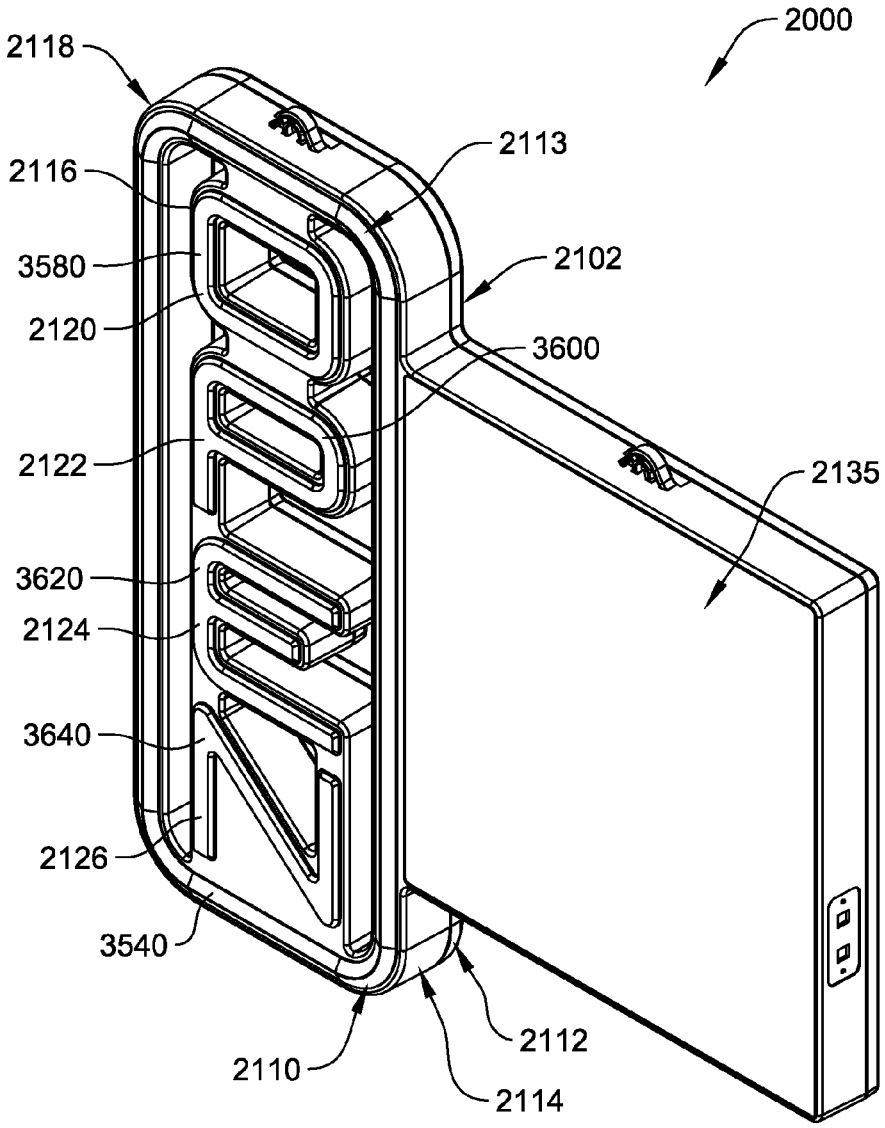
FIG. 10 is a perspective of another suitable embodiment of a lighting assembly.

With reference now to FIG. 10, another suitable embodiment of a lighting assembly is indicated generally at 2000. As seen in FIG. 10, the lighting assembly 2000 depicts indicia 2116. In the illustrated embodiment, the lighting assembly 2000 depicts the word "OPEN". Specifically, the illustrated indicia 2116 includes an "O" 2120, a "P" 2122, an "E" 2124, and an "N" 2126. Although the lighting assembly 2000 depicts the word "OPEN", it is understood that other messages or representations, including alphabetical and/or numerical characters (i.e., alphanumeric characters), symbols, graphic elements, features of an object, images, and/or any combination of thereof can be depicted by the lighting assembly without departing from some aspects of this disclosure.

In the illustrated embodiment, the lighting assembly 2000 includes a housing assembly indicated generally at 2102, first and second light sources (not shown) located within the housing assembly, and a cover assembly indicated generally at 2110. While the first and second light sources of this embodiment are not shown, it is contemplated that the light sources can be substantially the same as the lights sources described above with respect to the previous embodiments.

In the embodiment illustrated in FIG. 10, the housing assembly 2102 includes a base, indicated generally at 2112, and a housing compartment, indicated generally at 2114. The base 2102 and housing compartment 2114 are coupled together to define the housing assembly 2102. It is contemplated that the housing assembly 2102 can be formed as a single-piece without departing from some aspects of this disclosure.

As seen in FIG. 10, the housing assembly 2102 and the cover assembly 2110 collectively define the indicia 2116 depicted by lighting assembly 2100. A border, indicated generally at 2118, extends around the indicia 2116. In the illustrated embodiment, the border 2118 is continuous but it is understood that the border can be defined by two or more discrete sections without departing from some aspects of this disclosure.

As seen in FIG. 10, the lighting assembly 2000 includes a display indicated generally at 2135. The display 2135 is configured to display messages, indicia, representations, or other graphic elements (collectively referred to as "a message" or "messages") printed or written on the display. For example, message on the display 2135 can be hours of operation.

The cover assembly 2100 includes an outer cover 3540 and a plurality of inner covers 3580, 3600, 3620, 3640 with each of the inner covers corresponding to a respective one of the "O" 2200, "P" 2220, "E" 2240, and "N" 2260. During use, the inner covers 3580, 3600, 3620, 3640 are illuminated by the first light sources and the outer cover 3540 is illuminated by the second light sources. Each of the inner covers 3580, 3600, 3620, 3640 includes a front facet that is substantially co-planar with the front facets of the other inner covers.

The above described lighting assemblies provide an enhanced visual appearance compared to conventionally illuminated signs. Specifically, the lighting assemblies described herein utilize light barriers between transparent or translucent light covers illuminated with different colored light to prevent bleeding or interference between the different colored lights. Further, the lighting assemblies described herein utilize point light sources spaced apart from one another by an optimum distance to provide a continuous, uniform appearance of an illuminated message or representation depicted by the lighting assembly. Yet further, the lighting assemblies described herein utilize a lighting assembly having a substantially planar front surface to provide an enhanced three-dimensional appearance of the lighting assembly. Yet even further, the lighting assemblies described herein utilize translucent or transparent covers having front facets, side facets and angled facets to provide an enhanced three-dimensional appearance of the lighting assembly. Yet even further, the lighting assemblies described herein utilize side facets spaced apart such that the distance between external surfaces of the side facets is based upon a corresponding width of the front surface of the corresponding cover.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A lighting assembly comprising:

a housing assembly;

a first light source located within the housing assembly;

a second light source located within the housing assembly;

a first cover positioned relative to the first light source so that the first light source is able to illuminate the first cover;

a second cover positioned separately from the first cover and relative to the second light source so that the second light source is able to illuminate the second cover; and a light barrier disposed between the first and second covers, the light barrier being configured to prevent interference between the first light source and the second light source.

2. A lighting assembly in accordance with claim 1 wherein the light barrier directly abuts the first cover and the second cover.

3. A lighting assembly in accordance with claim 1 wherein each of the first and second covers has an outer facing surface and the light barrier has an outer facing surface, the outer facing surfaces of the first cover, the second cover, and the barrier layer being co-planar.

4. A lighting assembly in accordance with claim 1 wherein the first cover defines a letter and the second cover defines a border.

5. A lighting assembly in accordance with claim 4 wherein letter impinges upon the border to define an overlapping region.

6. A lighting assembly in accordance with claim 5 wherein the light barrier comprises a first light barrier and the lighting assembly further comprises a second light barrier, the first and second light barriers being spaced from each other and disposed within the overlapping region.

7. The lighting assembly in accordance with claim 6 wherein the lighting assembly further comprises a third light barrier, the third light barrier being spaced from the first and second light barriers.

8. A lighting assembly comprising:

a housing assembly;

a cover assembly coupled to the housing assembly, the cover assembly including at least one inner cover defining a word and an outer cover at least in part defining a border surrounding the word defined by the inner cover;

a first light source located within the housing assembly and positioned relative to the inner cover so that the first light source is able to illuminate the inner cover;

a second light source located within the housing assembly and positioned relative to the outer cover so that the second light source is able to illuminate the outer cover; and a light barrier disposed between the inner and outer covers, the light barrier being configured to prevent interference between the first light source and the second light source.

9. The lighting assembly in accordance with claim 8 wherein the inner cover comprises a plurality of inner covers, each of the inner covers defining a letter of the word.

10. The lighting assembly in accordance with claim 8 wherein the word defined by the inner cover is OPEN.

11. The lighting assembly in accordance with claim 10 wherein the "O" of OPEN impinges upon the border defined by the outer cover, the light barrier defining the portion of the border impinged by the "O" thereby spacing the "O" from the outer cover.

12. The lighting assembly in accordance with claim 10 wherein the "N" of OPEN impinges upon the border defined by the outer cover, the light barrier defining the portion of the border adjacent the "N" thereby spacing the "N" from the outer cover.

13. The lighting assembly in accordance with claim 12 wherein the light barrier comprises a first light barrier and a second light barrier, the first light barrier being disposed on one side of the "N" and the second light barrier being disposed on the opposite side of the "N".

14. The lighting assembly in accordance with claim 8 wherein inner cover comprises a front facing facet, a pair of angled facets with the angled facets being disposed on opposite sides of the front facing facet, and a pair of side facets wherein each of the side facets extend downward from a respective one of the angled facets.

15. A lighting assembly comprising:

a housing assembly;

a cover assembly coupled to the housing assembly, the cover assembly including at least one inner cover defining a word and an outer cover at least in part defining a border surrounding the word defined by the inner cover;

a first light source located within the housing assembly and positioned relative to the inner cover so that the first light source is able to illuminate the inner cover;

a second light source located within the housing assembly and positioned relative to the outer cover so that the second light source is able to illuminate the outer cover; and a light barrier is formed separately from and coupled to the outer cover to block light from the second light source.

16. The lighting assembly in accordance with claim 15 wherein the outer cover is divided into two visible segments by the light barrier.

17. The lighting assembly in accordance with claim 16 wherein the outer cover is elliptical and the light barrier extends along a centerline of the elliptical shaped border.

18. The lighting assembly in accordance with claim 17 wherein the outer cover slopes downward from both sides of the light barrier.

19. The lighting assembly in accordance with claim 16 wherein one of the visible segments is disposed outside the light barrier and the other visible segment is located inside the light barrier.

* * * * *